US009201334B2

(12) United States Patent
Yamashita et al.

(10) Patent No.: US 9,201,334 B2
(45) Date of Patent: Dec. 1, 2015

(54) RESIDUAL VOLTAGE REDUCING PROCESSING CARTRIDGE, IMAGE FORMING APPARATUS WITH SAME, AND IMAGE FORMING METHOD

(71) Applicants: Masahide Yamashita, Tokyo (JP); Mayumi Yoshihara, Kanagawa (JP)

(72) Inventors: Masahide Yamashita, Tokyo (JP); Mayumi Yoshihara, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/469,706

(22) Filed: Aug. 27, 2014

(65) Prior Publication Data

US 2015/0071662 A1 Mar. 12, 2015

(30) Foreign Application Priority Data

Sep. 6, 2013 (JP) ..... 2013-184734

(51) Int. Cl.
*G03G 15/02* (2006.01)
*G03G 15/00* (2006.01)

(52) U.S. Cl.
CPC ..... *G03G 15/0266* (2013.01); *G03G 15/751* (2013.01); *G03G 2215/00962* (2013.01)

(58) Field of Classification Search
CPC ..... G03G 15/0266; G03G 15/751; G03G 2215/00962
USPC ..... 399/50, 159
See application file for complete search history.

(56) References Cited

U.S. PATENT DOCUMENTS

| | | | | |
|---|---|---|---|---|
| 5,159,388 | A * | 10/1992 | Yoshiyama et al. | 399/26 |
| 6,355,389 | B1 | 3/2002 | Miyamoto | |
| 8,326,165 | B2 * | 12/2012 | Kubo et al. | 399/51 |
| 2006/0275685 | A1 * | 12/2006 | Kimura | 430/97 |
| 2008/0152396 | A1 * | 6/2008 | Yamamoto et al. | 399/286 |
| 2013/0236820 | A1 * | 9/2013 | Ide et al. | 430/56 |

FOREIGN PATENT DOCUMENTS

| | | | |
|---|---|---|---|
| JP | 01177062 | A * | 7/1989 |
| JP | 10-232544 | | 9/1998 |
| JP | 2001-051465 | | 2/2001 |
| JP | 2005-189319 | | 7/2005 |
| JP | 2008-122440 | | 5/2008 |
| JP | 2010-134153 | | 6/2010 |

* cited by examiner

*Primary Examiner* — Robert Beatty
(74) *Attorney, Agent, or Firm* — Harness, Dickey & Pierce, P.L.C.

(57) ABSTRACT

An image forming apparatus includes an electrophotographic photoreceptor that bears a latent image, an electrostatic charging unit that negatively charges the electrophotographic photoreceptor uniformly with electricity, and a latent image writing unit that writes a latent image on the electrophotographic photoreceptor. A one-component developing unit renders the latent image visible by developing thereof. A transfer device transfers the toner image from the electrophotographic photoreceptor onto a transfer medium. The inequality $C \times V < Q \leq 1.5 \times C \times V$ is satisfied where C is an electrostatic capacitance of the electrophotographic photoreceptor, V is an absolute value of a surface potential of the electrophotographic photoreceptor after it is electrically charged by the electrostatic charging unit in an electrostatic charging process, and Q is an absolute value of an electrical charge calculated based on an amount of electrical current sent to the electrophotographic photoreceptor in the electrostatic charging process.

18 Claims, 4 Drawing Sheets

FIRST CHEMICAL FORMULA

SECOND CHEMICAL FORMULA

THIRD CHEMICAL FORMULA

RESIDUAL VOLTAGE REDUCING PROCESSING CARTRIDGE, IMAGE FORMING APPARATUS WITH SAME, AND IMAGE FORMING METHOD

CROSS-REFERENCE TO RELATED APPLICATION

This patent application is based on and claims priority pursuant to 35 U.S.C. §119(a) to Japanese Patent Application No. 2013-184734, filed on Sep. 6, 2013 in the Japan Patent Office, the entire disclosure of which is hereby incorporated by reference herein.

BACKGROUND

1. Technical Field

This invention relates to a process cartridge and an image forming apparatus and method, and in particular, to a system employed in the image forming apparatus with an electrophotographic system to stabilize image quality. Especially, this invention relates to a system capable of suppressing generation of a defective image such as a ghost image, etc., generally caused by a residual voltage remaining on a latent image bearer.

2. Related Art

In an electrophotographic system, an electrostatic latent image is initially formed on a photoreceptor as a latent image bearer electrically charged uniformly beforehand. The electrostatic latent image is subsequently rendered visible as a toner image using toner in a development process. The toner image is subsequently transferred onto a transfer medium, such as a recording sheet, etc., and is subsequently fixed thereon. The transfer medium with the printed image is then outputted from the electrophotographic system.

As devices to execute the above-described series of processes, an electrostatic charging unit, a latent image writing unit, a developing unit, a transfer device, and a fixing device are typically used, respectively.

As the electrostatic charging unit, either a non-contact type electrostatic charging system or a contact type electrostatic charging system may be employed. As a non-contact type electrostatic charging system, a corona discharging system is well known. As a contact type electrostatic charging unit there is a system that employs a proximity electrostatic charging unit to place the electrostatic charging unit near the latent image bearer with a given amount of clearance. Also known as a contact type electrostatic charging system is a system that brings an electrostatic charging unit, such as a charging brush, a charging roller, etc., in contact with a latent image bearer.

The developing unit utilizes one-component developer or two-component developer, As the one-component developer, only developer such as magnetic toner, etc., capable of standing the particles up on end by itself is used, for example. As the two-component developer, toner particles and carriers, such as iron filings, etc., capable of raising the particles on end while bearing the toner particles on the carriers are used.

In a conventional copier, printer, or multifunctional machine, since high-speed performance, high image reproducibility, long-term stability of image quality, quick startup performance, stability of electrostatic charging of toner, etc., are required, a two-component developing unit using the two-component developer is frequently adopted. By contrast, in a compact printer or facsimile machine expected to save cost and space or the like, a one-component developing unit with the one-component developer is frequently adopted.

Today, since an output image is increasingly colorized, a stabilized high quality image is more intensively demanded than before.

Typically, a latent image is formed as a latent image pattern on a photoreceptor acting as a latent image bearer by a latent image forming device such as an optical writing unit, etc., using a laser light beam after or at the same time as the electrophotographic photoreceptor is electrically charged uniformly in accordance with an image pattern to be obtained.

To consistently obtain a quality image, it is of course important to stabilize both latent image formation and visualization such as development, etc., of a latent image. To further stabilize image quality, it becomes important to uniformly maintain an electrical charge on the electrophotographic photoreceptor while suppressing variation in electrostatic charge potential that sometimes appears locally within the site of latent image formation.

The above-described contact and non-contact type systems can be selectively employed in the electrostatic charging unit. However, although it is capable of electrostatically charging a target uniformly with electricity, the non-contact type system discharges a great amount of ozone or similar material when operated. Accordingly, the above-described contact type electrostatic charging system is often used as the electrostatic charging unit to avoid such a problem.

Also, a potential on the electrophotographic photoreceptor needs to be controlled within a given range by detecting its chronological deviation to obtain a quality image, especially with reproducibility in a halftone portion thereof. Consequently, an electrically charged potential on the electrophotographic photoreceptor is typically controlled and used within a range, in which an amount of electrical charge applied to the electrophotographic photoreceptor is proportional to the electrically charged potential thereof.

In this respect, various systems described herein below have been proposed to meet the above-described requirements.

For example, a first conventional system utilizes a ghost image detecting system to detect occurrence of a ghost image in a halftone portion on the electrophotographic photoreceptor by recognizing a difference in at least one of a surface potential and a toner adhering amount on the electrophotographic photoreceptor. In such a system, a condition of forming an image on the electrophotographic photoreceptor is corrected by a prescribed correcting system to check the occurrence of the ghost image based on a pattern formed thereon.

A second conventional system employs a residual voltage detecting unit to detect a residual voltage remaining on a photoreceptor surface between a transfer device and an auxiliary electrostatic charging unit arranged downstream of the transfer device in a rotative direction of the electrophotographic photoreceptor. In this system, a history of a residual image is cancelled by adjusting a condition of a bias voltage applied to the auxiliary electrostatic charging unit in accordance with the residual voltage detected by the residual voltage detecting unit.

A third conventional system employs a pre-electrostatic charging process-biasing device located downstream of a lubricant coating unit and upstream of an electrostatic charging unit to apply a prescribed biasing potential, which is greater than an electrical charge start voltage having the same polarity therewith applied by the electrostatic charging unit, to a section of an electrophotographic photoreceptor prior to an electrostatic charging process. In this system, a history of a residual image generated by a pre-transfer process exposing process is cancelled.

A fourth conventional system simply handles an amount of electrical charge generated in developer without applying an electrostatic charging bias.

Since it is important for the image forming apparatus to evenly obtain prescribed image quality in an image portion, an electrophotographic photoreceptor needs a prescribed amount of electrical charge potential thereon, and various methods of controlling the electrical charge potential have been practically proposed as of today.

SUMMARY

Accordingly, one aspect of the present invention provides a novel image forming apparatus that includes an electrophotographic photoreceptor that bears a latent image, an electrostatic charging unit that negatively charges the electrophotographic photoreceptor with electricity uniformly in an electrostatic charging process, and a latent image writing unit that writes a latent image on the electrophotographic photoreceptor electrically charged uniformly. A one-component developing unit is provided to render the latent image visible with one-component developer. A transfer device is provided to transfer the toner image developed from the electrophotographic photoreceptor to a transfer medium. The inequality $C \times V < Q \leq 1.5 \times C \times V$ is satisfied where C is an electrostatic capacitance of the electrophotographic photoreceptor, V is an absolute value of a surface potential of the electrophotographic photoreceptor after electrically charged by the electrostatic charging unit in the electrostatic charging process, and Q is an absolute value of an electrical charge calculated based on an amount of electrical current sent to the electrophotographic photoreceptor in the electrostatic charging process.

Accordingly, by providing a prescribed an amount of electrical charge to an electrophotographic photoreceptor acting as a latent image bearer uniformly, an electrical charging process can be constant stabilizing a toner adhering amount thereto while preventing a problem such as occurrence of a ghost image, etc., on the electrophotographic photoreceptor. Consequently, an image quality can be stabilized while reducing initial and maintenance costs generally paid to prevent the ghost image.

Another aspect of the present invention provides a novel process cartridge disposed in each of multiple color image forming stations provided in the image forming apparatus. The process cartridge includes: an electrophotographic photoreceptor; an electrostatic charging roller to uniformly charge the electrophotographic photoreceptor with electricity in an electrostatic charging process, a one-component developing unit to render the latent image visible as a toner image with one-component developer composed of toner particles. The following inequality is satisfied when an electrostatic capacitance of the electrophotographic photoreceptor is C, an absolute value of a surface potential of the electrophotographic photoreceptor after electrically charged by the electrostatic charging unit in the electrostatic charging process is V, and an absolute value of an electrical charge calculated based on an amount of electrical current sent to the electrophotographic photoreceptor in the electrostatic charging process is Q; $C \times V < Q \leq 1.5 \times C \times V$.

Yet another aspect of the present invention provides a novel method of forming an image including the steps of: bearing a latent image on an electrophotographic photoreceptor; negatively charge the electrophotographic photoreceptor with electricity uniformly with an electrostatic charging unit in an electrostatic charging process; satisfying an inequality of $C \times V < Q \leq 1.5 \times C \times V$ where C is an electrostatic capacitance of the electrophotographic photoreceptor, V is an absolute value of a surface potential of the electrophotographic photoreceptor after electrically charged by the electrostatic charging unit in the electrostatic charging process, and Q is an absolute value of an electrical charge calculated based on an amount of electrical current sent to the electrophotographic photoreceptor in the electrostatic charging process; writing a latent image on the electrophotographic photoreceptor electrically charged uniformly with a latent image writing unit; rendering the latent image visible as a toner image with one-component developer composed of toner particles with a one-component developing unit; and transfer the toner image developed by the one-component developing unit from the electrophotographic photoreceptor to a transfer medium.

BRIEF DESCRIPTION OF THE DRAWINGS

A more complete appreciation of the present invention and many of the attendant advantages thereof will be more readily obtained as substantially the same becomes better understood by reference to the following detailed description when considered in connection with the accompanying drawings, wherein.

DETAILED DESCRIPTION

Figure 1:
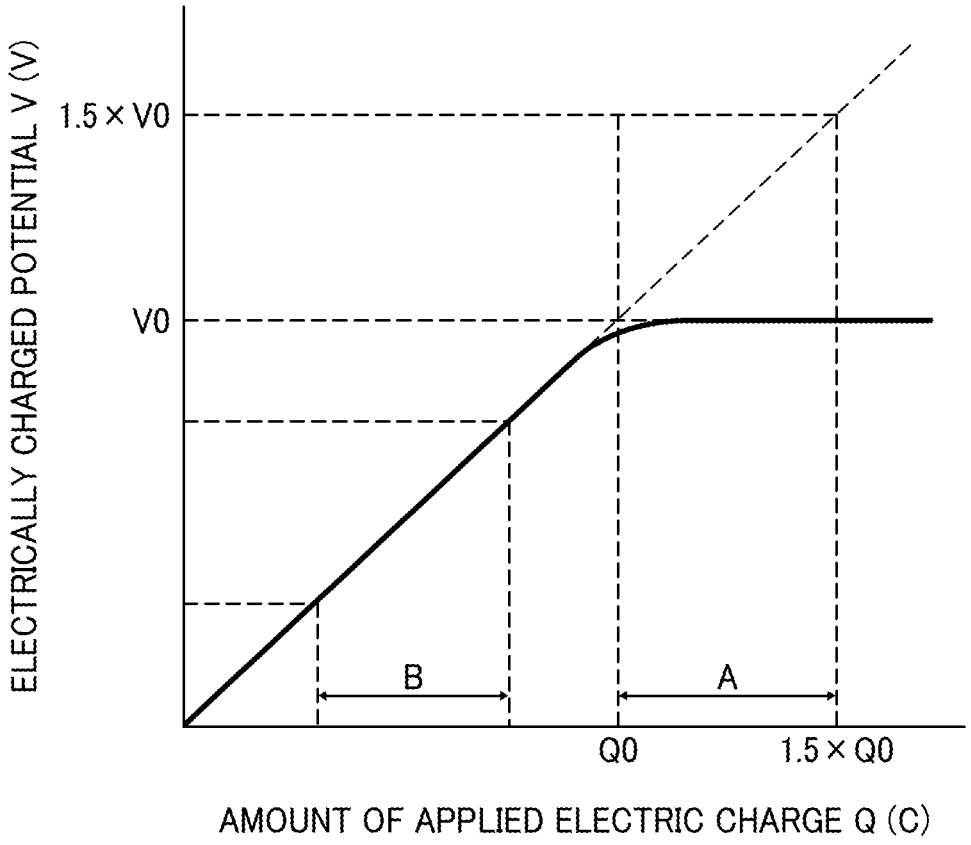
FIG. 1 is a graph illustrating a relation between an applied electrical charge and an electrically charged potential obtained and used in an image forming apparatus according to one embodiment of the present invention.

Referring now to the drawings, wherein like reference numerals designate identical or corresponding parts throughout the several views thereof, and characteristics of an image forming apparatus according one typical embodiment of the present invention are initially summarized. That is, this invention focuses on a stand point characterized in that an electrically charged potential on a photoreceptor used in an image forming process is nearly equalized with an electrostatic maximum potential maintainable by the electrophotographic photoreceptor, so that a uniform latent image potential can be constantly generated thereon without additionally employing a special member or a mechanism. Especially, by using a one-component developing unit as a developing unit, the upper most amount of toner supplied to the electrophotographic photoreceptor is limited in the developing process. Hence, it is recognized that a stable and uniform toner visible image can be formed in both initial and chronological stages and accordingly a stable quality image can be obtained as a final image.

Now, a background and focusing point of various embodiments of the present invention is described based on the above-described electrical charge amount, especially an electrically charged condition that affects a residual voltage that typically generates a ghost image. FIG. 1 is a diagram illustrating a relation between an electrically charged electrical potential on both a commonly used photoreceptor and a photoreceptor employed in an image forming apparatus of various embodiments of the present invention each acting as a latent image bearer and an amount of electrical charge given thereto. In FIG. 1, a horizontal axis indicates an electrical charge amount given to the electrophotographic photoreceptor and a vertical axis indicates a surface potential on the electrophotographic photoreceptor corresponding to the electrical charge amount given to the electrophotographic photoreceptor. As shown there, an amount of the surface potential increases in proportion to the amount of electrical charge given to a photoreceptor (hereinafter, simply referred to as a photoreceptor for convenience) acting as a latent image bearer in a relatively smaller amount of electrical charge that the electrophotographic photoreceptor can hold. For this reason, when the giving electrical charge becomes excessive, the electrophotographic photoreceptor can no longer hold the electrical charge thereon and an excessive electrical charge leaks, so that the surface potential thereof indicates a prescribed level. Here, as shown in FIG. 1, the reference code V0 indicates the maintainable electrical charge potential on the electrophotographic photoreceptor. The minimum applied electrical charge to obtain the potential V0 is indicated by Q0. The applied electrical charge (i.e., Coulomb=Ampere second) can be also calculated as a value per unit area based on an amount of electrical current (e.g., ampere) sent to the electrophotographic photoreceptor, an electrostatic charging width (i.e., meter) thereof, and a moving speed (i.e., meter/sec) of the electrophotographic photoreceptor as well.

Usually, the electrical charge potential on the electrophotographic photoreceptor is controlled in a range (i.e., almost a range B in the drawing), in which a proportional relation is established between the applied electrical charge and the electrically charged potential obtained thereon. Hence, since an electrically charged potential can be finely controlled in this control range B, a halftone image can be effectively or precisely represented by using exposure intensity control while applying multiple value control to a latent image potential as an advantage. However, in this control range B, since an image is susceptible to a residual voltage, a defective image such as a ghost image, etc., may be generated thereby necessitating a supplementary device to eliminate such a problem as conventionally employed.

Whereas, in a current proliferation of digitization of an image forming apparatus, the above-described multi-value control of the latent image potential is not necessarily required these days. Specifically, image formation using the so-called area gradation (i.e., area coverage modulation) is widely used, in which a tint (i.e., light and shade) of an image is adjusted by an area of a latent image. In such a situation, since the halftone does not need to be represented by using multi-value control based on the latent image potential, an impact of the residual voltage can be substantially avoided if an electrical charge maximum potential maintainable by the electrophotographic photoreceptor is utilized as a potential in a pre-exposure process.

To render a potential of the electrophotographic photoreceptor to be the electrical charge maximum potential maintainable by the electrophotographic photoreceptor before the exposure process, an amount of electrical charge exceeding the value Q0 may be simply given to the electrophotographic photoreceptor. However, when the electrical charge giving amount (i.e. a current amount) per unit time is excessive, electrostatic damage on the electrophotographic photoreceptor grows, thereby shortening its lifespan sometimes. It is, however, confirmed that when an amount of the giving electrical charge is suppressed not to exceed 1.5 times of the value Q0, the electrical charge potential can be made uniform over the entire area, so that a high quality image can be obtained while excluding an uneven image.

This also leads to a better result in that the image forming apparatus is simplified and cost effective while obtaining a stable quality image at low cost. Such advantages can be greatly demonstrated especially in a compact and low-cost image forming apparatus.

Whereas, in an image forming process, in which an electrically charged potential is almost equalized with an electrically charged maximum potential maintainable by the electrophotographic photoreceptor, a relatively large electrostatic potential cannot be employed. Because of this, a difference in potential between an image portion and a non-image portion (i.e., the so-called latent image potential) is obliged to be relatively small. To form a visible image with toner based on an electrostatic latent image having the small latent image potential like this, an amount of electrical charge held by toner particles needs to be reduced so that a certain amount of toner particles can precisely bear the latent image potential. However, when the amount of electrical charge of the toner particles is reduced, an electrical charge amount of the toner usually largely distributes relatively, and a number of toner particles having an extraordinary amount of electrical charge increases. By contrast, when the latent image potential of the electrophotographic photoreceptor is relatively large by a certain degree, a developing bias voltage can be adjusted so that the toner particles with an extraordinary amount of electrical charge can be prevented to adhere to the non-image portion. Specifically, when the latent image potential of the electrophotographic photoreceptor is relatively small, since an adjustable width of the developing bias voltage is narrow, the electrical charge amount of toner needs to be controlled within a narrow range. As a result of investigation on this point, various embodiments of the present invention each utilizes a one-component developing unit. In other words, when the one-component developing unit is employed and the upper limit of a supplying amount of toner involved in developing is set to a prescribed level, the toner capable of developing dries out even if an amount of electrical charge on the toner varies. Consequently, it is confirmed that the developing process is completed while avoiding a variation of the toner adhering amount even if the electrical charge on the electrophotographic photoreceptor is not neutralized. It is also focused on a point in that a prescribed amount of electrical charge can be given to toner in the one-component developing unit in commensurate with the image forming process, in which an amount of electrical charge on the electrophotographic photoreceptor is equalized with the electrically charged maximum potential maintainable by the electrophotographic photoreceptor.

Now, an exemplary system is described as a basis of various practical examples of the present invention based on the above-described background and focusing point. Here, terminologies described herein below in the various practical examples are used to mean as follows.

An image forming apparatus indicates and includes a printer, a facsimile machine, a copier, a plotter, and a complex machine having multiple functions of these devices, etc., for example.

A recording medium indicates and includes a medium made of, such as paper, yarn, fiber, leather, metal, plastic, glass, wood, ceramics, etc., for example. In the following example, a paper sheet is typically used and described as the recording medium.

The term image formation means production of images, such as characters, shapes, patterns, etc., on the recording medium, visualizing an electrostatic latent image with coloring or non-coloring powder for example, toner, and transferring and fixing the image onto the recording medium, sometimes via an intermediate medium upon need.

The colored or non-colored powder includes single resin powder, composite powder, single or multiple color materials, chemical compounds of resins and colorants, and powder prepared by adding wax ingredients or inorganic materials to these materials. Also, the term colored or non-colored powder is used as a generic name indicating all of powders including functional powder prepared by applying high-order form control, such as toner, etc., capable of forming an image. For example, the term colored or non-colored powder includes gloss suppressing powder, glossy giving powder, baking powder, and effervescent foaming powder or the like. However, the powder is described herein below as the toner.

A process cartridge indicates and includes a device prepared by integrating one or all of component elements (i.e., members or devices) needed to form an image, and at least includes a latent image bearer, in other words, an electrophotographic photoreceptor (herein after, sometimes simply referred to as a photoreceptor). The process cartridge also sometimes indicates and includes one or all of component elements needed to execute various processes in the electrophotographic system, such as an electrostatic charging process, a process of forming an electrostatic latent image executed by writing an image, a process of rendering the electrostatic latent image visible with toner in one-component developer, a process of transfer the toner image thus developed onto the paper sheet or the intermediate transfer member, and that of cleaning the electrophotographic photoreceptor after the toner image transfer process.

Figure 2:
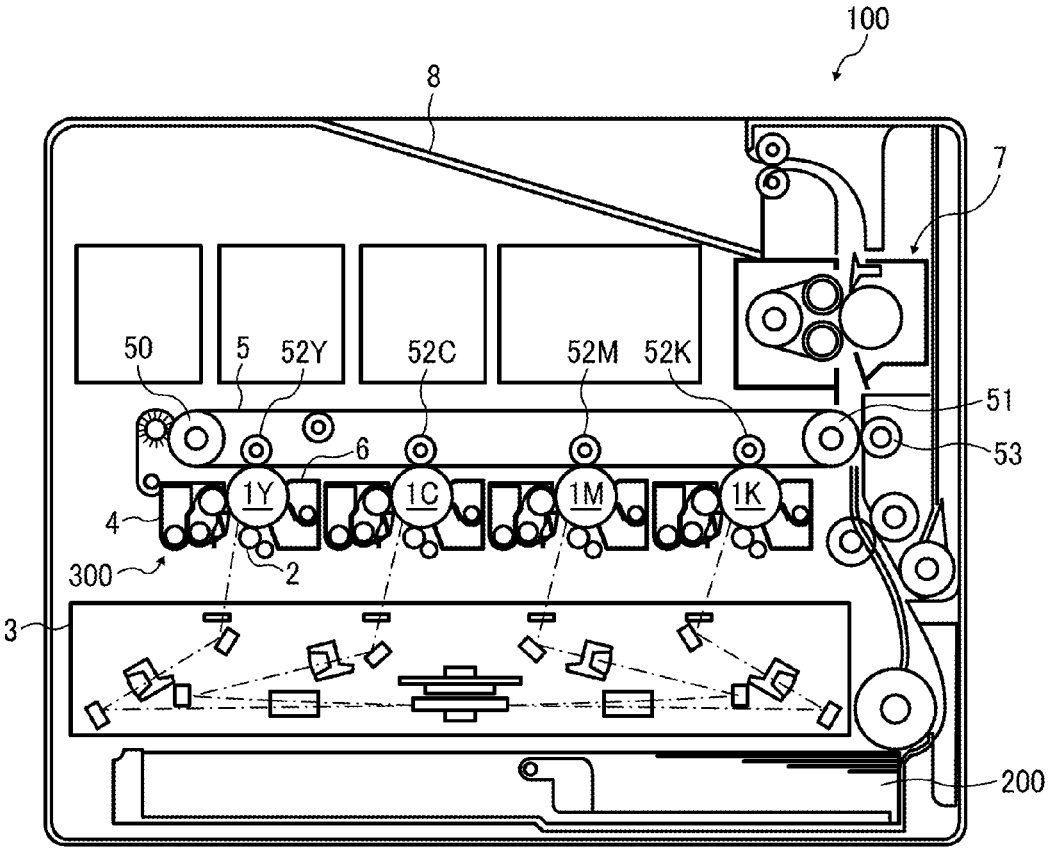
FIG. 2 is a diagram schematically illustrating an exemplary configuration of the image forming apparatus according to one embodiment of the present invention.

Now, the image forming apparatus of this embodiment is described in more detail with reference to FIG. 2. Specifically, FIG. 2 illustrates an exemplary image forming apparatus 100 according to this embodiment of the present invention. An image forming unit 10 included in the image forming apparatus 100 includes multiple electrophotographic photoreceptors 1Y, 1C, 1M, and 1K. These photoreceptors 1Y, 1C, 1M, and 1K are provided in a conveyance direction of the intermediate transfer belt 5. Herein below, when the electrophotographic photoreceptors 1Y, 1C, 1M, and 1K are referred to in a block, it is simply referred to as the electrophotographic photoreceptor 1. These photoreceptors 1Y, 1C, 1M, and 1K may be drum-shaped and bear toner images of respective colors (for example, yellow, cyan, magenta, and black) including photoconductive layers. The images are written onto the electrophotographic photoreceptor 1 by an optical writing unit 3. Around each of the electrophotographic photoreceptors 1Y, 1C, 1M, and 1K, an electrostatic charging unit 2, a writing unit 3, a developing unit 4, an intermediate transfer belt 5, and a cleaning unit 6 are deployed.

The intermediate transfer belt 5 is stretched and wound around a pair of rollers 50 and 51. Inside the intermediate transfer belt 5, corresponding to respective photoreceptors 1, multiple primary transfer rollers as primary transfer devices 52Y, 52C, 52M, and 52K are disposed. Also, at a location opposite the roller 51, a secondary transfer roller 53 as a secondary transfer device is disposed to transfer an overlaid image from the intermediate transfer belt 5 onto the recording medium at once.

The writing unit 3 is used in an electrostatic latent image forming process, but is not limited to a particular device that forms an electrostatic latent image. In other words, any type of the writing unit 3 can be employed if it can form the electrostatic latent image after the electrophotographic photoreceptor 1 is electrically charged by the electrostatic charging unit 2 as described below more in detail.

As an electrostatic charging system implemented in the above-described electrostatic charging process, a system that applies a voltage onto a surface of the electrophotographic photoreceptor 1 with the below described electrostatic charging unit 2 can be used, for example. The electrostatic charging unit 2 used in the electrostatic charging process is not limited to a particular type, and can appropriately choose any type depending on a usage purpose. For example, a known contact type electrostatic charging unit that includes one of a conducting or semiconductive roller, a brush, a film, and a rubber blade or the like can be used. Also used is a non-contact type electrostatic charging system that uses a corona discharging system, such as a corotron charger, a scorotron charger, etc. Especially, a so-called roller type electrostatic charging unit that brings the conducting or semiconductive roller, to which a DC (Direct Current) voltage is applied, in contact with the electrophotographic photoreceptor 1 is preferably employed to electrostatically charge thereof while avoiding generation of discharged products such as ozone, etc. Also, when a contact type electrostatic charging unit having an electrically charging roller is used, a soft contact type electrostatic charging roller or an electrostatic charging unit omitting a pressure member not to apply great pressure to a contact section therebetween is more favorably employed.

The writing unit 3 used in the electrostatic latent image forming process can expose a surface of the electrophotographic photoreceptor using a writing exposure unit, for example, in accordance with an image. The writing exposure unit is not limited to a particular type and can choose any type depending on a usage purpose if it can expose a prescribed position on a surface of the electrophotographic photoreceptor corresponding to an image to be formed thereon after it is electrically charged by the electrostatic charging unit 2. For example, various writing exposure units, such as a copier optical system, a rod lens array system, a laser optical system, an LCD (Liquid Crystal Display) shutter optical system, an LED (Light Emitting Diode) optical system, etc., can be employed. A backside writing system may also be adopted to provide writing exposure to the electrophotographic photoreceptor from a backside thereof in accordance with the image. When a halftone image is formed, an area gradation system that changes an exposed area in accordance with the image is preferably employed. The surface of the electrophotographic photoreceptor 1 is divided by the writing unit 3 into two portions having two latent image potentials, i.e., imaged and blank portions, respectively.

The developing unit 4 used as a developing unit forms a visible image by developing an electrostatic latent image formed on the electrophotographic photoreceptor 1 using one-component developer. The developing unit 4 has a developing sleeve 40, a one-component developer agitator 42, a supplying roller 41, and a thin layer forming member 43. The developing sleeve 40 bears and conveys the one-component developer to a position facing the electrophotographic photoreceptor 1. Between the electrophotographic photoreceptor 1 and the developing sleeve 40, there is formed a developing gap through the one-component developer. Since the developing gap is formed by taking a supplying amount of the one-component developer onto the developing sleeve 40, a thickness of the one-component developer, and a rotational speed of the developing sleeve 40 or the like into account, it cannot be necessarily predetermined. However, generally, an average value of the developing gap is preferably from about 0.2 mm to about 0.4 mm.

The developing unit 4 is not limited to a particular type and any type can be chosen from among publicly known types if it meets the above-described conditions. For example, the developing unit 4 at least preferably includes a container capable of containing a sufficient amount of one-component developer and a developing unit that can provide the one-component developer to the electrostatic latent image while either contacting or not contacting thereto.

The toner as the one-component developer is not limited to a particular type and can be appropriately chosen depending on a usage purpose. However, an average roundness of the toner (e.g., an average of roundness SR) represented by the following first formula is preferably from about 0.94 to about 1.00, and is more preferably from about 0.96 to about 0.99. This average roundness indicates a degree of unevenness of the toner particle and is 1.00 when the toner is perfectly spherical. Thus, the average roundness decreases as a shape of a surface of the toner particle becomes complex.

Roundness *SR*=Circumference of circle having the same area as projection area of toner particle/Circumference of toner particle (First Formula)

A mass average particle diameter (D4) of toner is not limited to a particular value and can be appropriately chosen depending on a usage purpose. However, the mass average particle diameter (D4) of toner is preferably from about 3 μm to about 10 μm and is more desirably from about 4 μm to about 8 μm. Because, in this range, dot reproduction performance is relatively excellent because the toner particle having a sufficiently small diameter is included corresponding to a very small latent image dot. Further because, when the mass average particle diameter (D4) is below 3 μm, transfer efficiency and blade cleaning performance likely readily deteriorate. Whereas, when the mass average particle diameter (D4) exceeds 10 μm, it may be difficult to suppress scattering of characters and lines.

As the cleaning unit 6 used in the cleaning process is not limited to a particular type and can be appropriately chosen depending on a usage purpose if it can clean the electrophotographic photoreceptor surface. For example, a cleaning blade that cleans the photoreceptor surface is preferably employed. In general, however, as the cleaning unit that cleans the electrophotographic photoreceptor 1, an electrostatic cleaning unit with a brush, to which a bias voltage having a reverse polarity to that of toner remaining on the electrophotographic photoreceptor 1 is applied, is employed beside the system using the cleaning blade.

Now, a process cartridge 300 used in an image forming process to accommodate various instruments and members thereof is described with reference to FIG. 3. Specifically, the process cartridge 300 can accommodate at least a photoreceptor 1 and a developing unit 4 or the like among various instruments used in executing an image forming process in a block and can be detachably attached to a body of the image forming apparatus.

Figure 3:
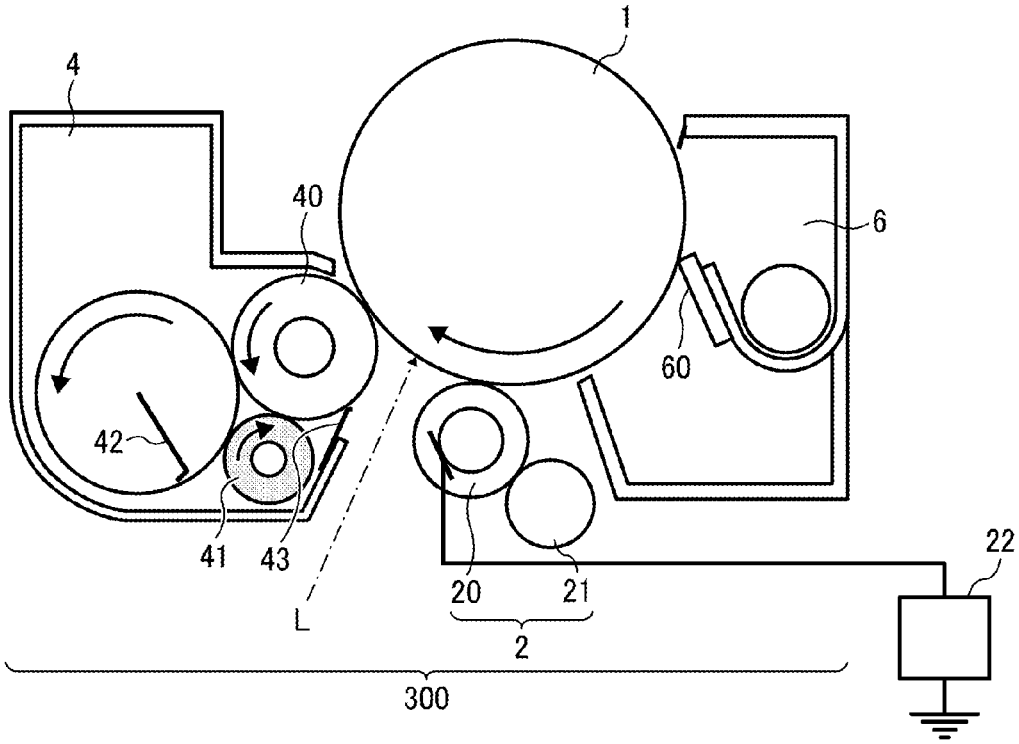
FIG. 3 is a diagram schematically illustrating an exemplary process cartridge used in the image forming apparatus shown in FIG. 2 according to one embodiment of the present invention.

FIG. 3 illustrates a configuration of the process cartridge 300 according to one embodiment of the present invention. Since the respective process cartridges 300 disposed in multiple color image forming stations have the same configuration with each other, suffixes indicating respective component colors are omitted as shown in FIG. 3 for the purpose of convenience. As shown in FIG. 3, the process cartridge 300 integrally accommodates a photoreceptor 1, an electrostatic charging unit 2, a developing unit 4, and a cleaning unit 6 in a block. The electrostatic charging unit 2 has an electrostatic charging roller 20 as a roller-shaped electrostatic charging unit and a roller-shaped electrostatic charging roller cleaner 21. A voltage applying device 22 grounded is connected to the electrostatic charging unit 2 to supply a prescribed amount of voltage (e.g., DC (Direct Current) voltage) to the electrostatic charging roller 20 as well.

The developing unit 4 includes a developing sleeve 40, a one-component developer agitator 42 that stirs and conveys thereby circulating the one-component developer stored in a developing casing, a supplying roller 41 that supplies the one-component developer onto the developing sleeve 40, and a thin layer forming blade that smooths the one-component developer borne on the developing sleeve 40 to have a predetermined thickness thereof. There is provided a toner replenishing unit, not shown, above the developer stirring and conveying unit 42 (i.e., one-component developer agitator 42). The cleaning unit 6 has a cleaning blade 60 that contacts a surface of the electrophotographic photoreceptor 1 via its leading end.

Figure 4:
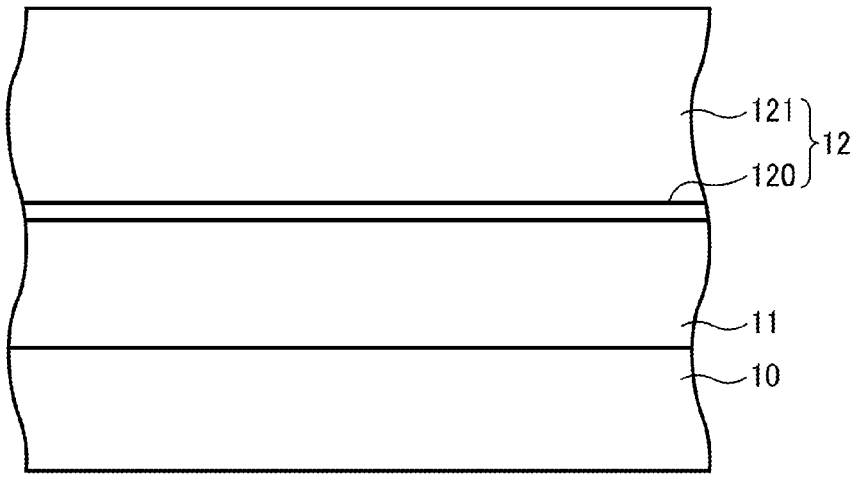
FIG. 4 is an enlarged view partially illustrating a layer structure of an electrophotographic photoreceptor serving as a latent image bearer according to one embodiment of the present invention.

Now, an electrophotographic photoreceptor used in an image forming process as a latent image bearer is described in more detail with reference to FIG. 4 that schematically illustrates one example of the electrophotographic photoreceptor 1 with a partially enlarged view. The photoreceptor 1 includes a substrate 10, an undercoat layer 11, and a photosensitive layer 12. The photosensitive layer 12 includes an electrical charge generating layer 120 and an electrical charge transporting layer 121. Now, the substrate 10, the undercoat layer 11, and the photosensitive layer 12 are herein below described more in detail.

Initially, the substrate 10 is herein below described more in detail. The substrate 10 used in the electrophotographic photoreceptor 1 is preferably conductive having a volume resistance of less than about $1.0\times10^{10}$ Ω/cm. However, any material can be chosen depending on a usage purpose. For example, the substrate 10 is prepared by covering plastic or tempered glass and the like with metal oxide, such as aluminum, nickel, chrome, nickel-chrome, copper, gold, silver, platinum, tin oxide, indium oxide, etc., by applying vapor deposition or sputtering thereto. The substrate 10 can be also prepared by initially producing an original pipe by either extruding or drawing one of aluminum, aluminum alloys, nickel, and stainless steel or the like, and subsequently applying surface treatment processes thereto, such as cutting, finishing, polishing, etc. The substrate 10 is preferably either a circular rigid pipe or a thin cylindrical member with sufficient tensile strength to obtain prescribed alignment precision and dimensional stability or the like needed in the image forming process.

The diameter of the substrate 10 is not limited to a particular size, and can be optionally chosen depending on a usage purpose. However, the diameter of the substrate 10 of from about 20 mm to about 150 mm is generally preferable, and is more preferably from about 24 mm to about 100 mm. A yet further particularly preferable diameter of the substrate 10 is of from about 28 mm to about 70 mm. Specifically, when the diameter of the substrate 10 is below about 20 mm, it becomes physically difficult to arrange the electrostatic charging unit, the exposing unit, the developing unit, the transfer device, and the cleaning unit around the electrophotographic photoreceptor 1. By contrast, when the diameter of the substrate 10 exceeds about 150 mm, the image forming apparatus 100 may be upsized.

Next, the undercoat layer 11 is herein below described more in detail. The above-described undercoat layer 11 is not limited to a particular type and may be composed of one or more layers. For example, the undercoat layer 11 can be made of one of material including resin as a main component, that including electron receiving material, N-type semiconductor particles, and resin as a main component, and an oxidized metal film prepared by chemically or electrochemically oxidizing a surface of a conductive substrate or the like. Among those, the material made of the electron receiving materials, N-type semiconductor particles, and resin as a main component is most preferably employed as the undercoat layer 11.

As the above-described electron receiving material, every material can be used if it can provide desired characteristics thereof. However, prescribed material having high affinity with the N-type semiconductor particle is preferably used. For example, a chemical compound having an anthraquinone structure with a hydroxyl group as a basic skeleton, such as a hydroxyanthraquinone chemical compound, an aminohydroxy-anthraquinone chemical compound, etc., may be preferably used. Specifically, 1,2-dihydroxy-9, 10-anthraquinone; 1,4-dihydroxy-9, 10-anthraquinone; 1,5-dihydroxy-9,10-anthraquinone; 1,2,4-trihydroxy-9, 10-anthraquinone; 1-hydroxyanthraquinone; 2-amino-3-hydroxyanthraquinone; and 1-amino-4-hydroxyl-anthraquinone or the like as exemplified. Otherwise, a fullerene derivative, such as phenyl-C61-butyric acid methyl ester, phenyl-C61-butyric acid butyl ester, phenyl-C61-butyric acid isobutyl ester, etc., can be also used as the electron receiving material as well.

The above-described N-type semiconductor particle is not limited to a particular type, and a particle made of metal oxide, such as zinc oxide, dioxide tin, indium oxide, ITO ((Indium Tin Oxide) e.g., $In_2O_3$:$SnO_2$=90:10 [WT (weight) %]), etc., or that prepared by processing a substrate particle made of inorganic oxide with these materials (i.e., metal oxide) can be used.

Also, the above-described resin is not limited to a particular type, and thermoplastic resin, such as for example, polyamide, polyvinyl alcohol, casein, methyl cellulose, etc., and thermosetting plastic, such as acrylic, phenol, melamine, alkyd, unsaturated polyester, epoxy, etc., can be used as well. Each of these may be used alone or being combined with the other one or more material. Since a thickness of the above-described undercoat layer 11 preferably changes in accordance with a kind and a combination of usage materials, a range thereof cannot not be predetermined. However, the thickness of the above-described undercoat layer 11 is preferably from about 0.5 μm to about 20 μm. In particular, to precisely prevent electrical charge injection from the substrate 10 while quickly attenuating an electrical charge generated in the electrical charge generating layer and a surplus electrical charge generated during the electrostatic charging process as well, a value of from about 2 μm to about 15 μm is more favorably employed.

Now, the photosensitive layer 12 is herein below described more in detail. The above-described photosensitive layer 12 is not limited to a particular type, and any type can be appropriately chosen depending on a usage purpose. For example, a single-layer type photosensitive layer prepared by mixing electrical charge generating material and electrical charge transporting material, a normal order layer type photosensitive layer prepared by stacking an electrical charge-transporting layer containing the electrical charge transporting material on an electrical charge generating layer containing electrical charge generating material, or a reverse layer type photosensitive layer prepared by stacking the electrical charge generating layer on the electrical charge-transporting layer is utilized. Here, a proper quantity of plasticizer, antioxidant, and a leveling agent may be added to each of the layers as needed. The thickness of the photosensitive layer 12 is not limited to a particular size, and any size can be appropriately chosen depending on a usage purpose. However, a value of from about 10 μm to about 50 μm is desirable. As the total thickness of the above-described undercoat layer 11 and the photosensitive layer 12, a value of from about 20 μm to about 60 μm is desirable. Because, when it is used satisfying the above-described range, a visible image can be uniformly formed for a long time, and accordingly, a stable image forming apparatus capable of reducing chronological fluctuations can be obtained. By contrast, however, when the thickness is below 20 μm, electrical uniformity of the electrophotographic photoreceptor is sometimes difficult to keep. When the thickness exceeds 60 μm, resolution of a latent image may undesirably deteriorate.

A general electrophotographic photoreceptor selectively employs material and a layer structure to hold an electrical charge as much as possible. The electrophotographic photoreceptor used in the image forming apparatus of the present invention also needs to hold a prescribed value of electrical charge. However, an existing electrophotographic photoreceptor sometimes holds an excessive electrical charge potential. Since the electrical charge potential to be held is affected by an amount of dark resistance and that of withstand voltage beside an electrostatic capacitance of the electrophotographic photoreceptor. Thus, a prescribed system is needed to let the surplus electrical charge evacuate from the surface of the electrophotographic photoreceptor.

As the electrical charge generating material included in the photosensitive layer, a chemical compound with a tetrabenzoporphyrin skeleton or the like is exemplified. As the chemical compound having the tetrabenzoporphyrin skeleton, unsubstituted tetrabenzoporphyrin, a complex prepared by introducing copper, silver, gold, platinum, nickel, calcium, strontium, barium, titanium, manganese, iron, cobalt, nickel, aluminum, and gallium or the like as central metal, and a chemical compound prepared by introducing alkyl group, phenyl group, halogen group, hydroxyl group, amino group, nitro group, and carboxyl group or the like as characteristic groups are exemplified. These are selectively used as necessary.

Also, as the electrical charge generating material, azo pigments, such as monoazo system pigments, bisazo pigments, trisazopigment, tetrakisazo pigments, etc., may be used as well. Also used as the electrical charge generating material is organic pigments or dye, such as triaryl methane dyes, thiazine dyes, oxazine dyes, xansubsequentlye dyes, cyanine dyes, styryl dye, pyrylium salt dyes, quinacridone pigment, indigo pigment, perylene pigment, multiple polycyclic quinone pigments, bisbenzimidazole pigment, indanthrene pigments, squarylium pigments, phthalocyanine pigment, etc. Yet also used is inorganic material, such as titanium oxide, a cadmium sulfide, zinc oxide, etc. These materials can be used together in various combinations as well.

As the electrical charge transporting material included in the photosensitive layer, anthracene derivatives, pyrene derivatives, carbazole derivatives, tetrazole derivatives, metallocene derivatives, phenothiazine derivatives, pyrazoline chemical compounds, hydrazone chemical compounds, styryl chemical compounds, styrylhydrazone chemical compounds, enamine chemical compound, butadiene chemical compound, distyryl chemical compounds, oxazole chemical compounds, oxadiazole chemical compounds, thiazole chemical compound, imidazole chemical compounds, triphenylamine derivatives, phenylenediamine derivatives, triphenylmethane derivatives, aminostilbene derivatives are exemplified, for example. These may be used alone or together with the other one or more types.

Binder resin included in the photosensitive layer has moderate electrical insulation performance and can itself employ known thermoplastic resin, thermosetting resin, light curable resin, and photoconductive resin or the like. For example, as the binder resin of the thermoplastic resin, polyvinyl chloride, polyvinylidene chloride, vinyl chloride-vinyl acetate copolymer, vinyl chloride-vinyl acetate-anhydrous maleic acid copolymer, ethylene-acetic acid vinyl copolymer, polyvinyl butyral, polyvinyl acetal, polyester, phenoxy resins, (meta) acrylic resin, polystyrene, polycarbonate, polyarylate, polysulfone, polyethersulfone, ABS resin, etc., are exemplified. Also exemplified as the binder resins of the thermosetting resin are phenolic resin, epoxy resin, polyurethane resin, melamine resin, isocyanate resin, alkyd resin, silicone resin, thermosetting acrylic resins, etc. Yet also exemplified as the binder resins are polyvinylcarbazole, polyvinylanthracene, and polyvinylpyrenes or the like are exemplified. These may be used alone or together with the other one or more types.

As an oxidation inhibitor included in the photosensitive layer, a phenolic chemical compound, p-phenylenediamine class, hydroquinone class, organic sulphur chemical compound class, and organic phosphorus chemical compound class or the like can be exemplified. As the above-described phenolic chemical compound, 2, 6-di-t-butyl-p-cresol; butylated hydroxyanisole; 2, 6-di-t-butyl-4-ethylphenol; stearyl-β-(3,5-di-t-butyl-4-hydroxyphenyl)propionate; 2, 2'-methylene-bis-(4-methyl-6-t-butylphenol); 2, 2'-methylene-bis-(4-ethyl-6-t-butylphenol); 4, 4'-thiobis-(3-methyl-6-t-butylphenol); 4, 4'-butylidenebis-(3-methyl-6-t-butylphenol); 1,1,3-tris-(2-methyl-4-hydroxy-5-t-butyl phenyl) butane; 1, 3, 5-trimethyl-2, 4, 6-tris (3, 5-di-t-butyl-4-hydroxybenzyl) benzene; tetrakis-[methylene-3-(3',5'-di-t-butyl-4'-hydroxyphenyl) propionate]methane; bis[3, 3'-bis (4'-hydroxy-3'-t-butylphenyl) butyric acid]glycolester; and tocopherol classes or the like are exemplified. As the above-described p-Phenylenediamine class, N-phenyl-N'-isopropyl-p-phenylenediamine; N,N'-di-sec-butyl-p-phenylenediamine, N-phenyl-N-sec-butyl-p-phenylenediamine; N,N'-di-isopropyl-p-phenylenediamine; N, N'-dimethyl-N, N'-di-t-butyl-p-phenylenediamine or the like are exemplified. As the above-described hydroquinone class, 2, 5-di-t-octyl hydroquinone; 2, 6-didodecyl hydroquinone; 2-dodecyl hydroquinone; 2-dodecyl-5-chlorohydroquinone; 2-t-octyl-5-methyl hydroquinone; and 2-(2-octadecenyl)-5-methyl hydroquinone or the like are exemplified. As the above-described organic sulfur chemical compound, dilauryl-3, 3'-thiodipropionate; distearyl-3, 3'-thiodipropionate; and ditetradecyl-3, 3'-thiodipropionate or the like are exemplified. As the above-described organic phosphorus chemical compounds, triphenylphosphine, tri (nonylphenyl) phosphine, tri (dinonylphenyl) phosphine, and tricresylphosphine, tri (2, 4-dibutylphenoxy) phosphine or the like are exemplified.

These chemical compounds are known as antioxidants for rubber, plastic, and oil and fat or the like, and are readily available commercially. An addition of the antioxidant is favorably from about 0.01 mass % to about 10 mass % of the total mass of an adding target layer.

As plasticizer included in the photosensitive layer, general resin plasticizer, such as dibutylphtalate, dioctyl phthalate, etc., is used as is. A usage amount of the plasticizer is preferably from about 0 mass parts to about 30 mass parts in relation to 100 mass parts of the binder resin.

Here, leveling agent may be added to the photosensitive layer. As the leveling agent, a silicone oil class, such as dimethyl silicone oil, methylphenyl silicone oil, etc., polymer or oligomer having a perfluoroalkyl group as a side chain are used. A usage amount of the leveling agent is desirably from about 0 mass parts to about 1 mass part in relation to 100 mass parts of the above-described binder resin.

Now, an image forming process implemented by using the above-described image forming stations of respective colors is described herein below. A series of the image forming processes is initially described using a negative to positive process. However, all of photoreceptors and all of developing units are commonly described, the electrophotographic photoreceptor is simply indicated by the reference numeral 1 and the developing unit by the reference numeral 4, respectively.

Prior to the image formation, the electrophotographic photoreceptor 1 having a photoconductive layer is negatively charged uniformly with electricity by the electrostatic charging unit 2 having an electrostatic charging unit. When the electrophotographic photoreceptor 1 is electrically charged by the electrostatic charging unit 2, a prescribed amount of electrical charge voltages enabling the electrophotographic photoreceptor 1 to bear the later described potential is applied from the later described voltage applying system to the electrostatic charging unit. At this moment, when the electrical charge is excessively applied from the electrostatic charging unit to the electrophotographic photoreceptor 1, specifically it exceeds a level that the electrophotographic photoreceptor 1 can hold, the electrical charge causes a leakage current, and eventually flows into a grounding electrode. With this, the electrophotographic photoreceptor 1 bears a prescribed electrostatic charge potential. In this practical example, an absolute value V of from about 200 volts to about 400 volts is chosen as the electrical charge potential of the electrophotographic photoreceptor 1. On the electrically charged photoreceptor 1, a latent image is formed by emitting a laser light beam thereonto from the writing unit 3 such as a laser optical system, etc. Specifically, the laser light emanates from a semiconductor laser, and scans a surface of the electrophotographic photoreceptor 1 in a rotary axis direction of the electrophotographic photoreceptor 1 as a polygonal prism (i.e., a polygon mirror) or the like rotates at high speed.

The electrostatic latent image formed in this way is developed by one-component developer composed of toner particles supplied to the developing sleeve 40 installed in the developing unit 4, thereby forming a toner visualizing image. During developing the electrostatic latent image, a developing bias having either a prescribed DC (Direct Current) voltage or a superimposed voltage prepared by superimposing the DC voltage with an AC (Alternating Current) voltage having a value between potentials of an exposed area and a non-exposed area on the electrophotographic photoreceptor 1 is applied from a developing bias applying system to the developing sleeve. The toner images formed on the electrophotographic photoreceptors 1Y, 1C, 1M, and 1K corresponding to respective colors are sequentially transferred onto the intermediate transfer belt 5 by the primary transfer rollers 52Y, 52C, 52M, and 52K acting as primary transfer devices. At this moment, to the primary transfer roller 52, a voltage having a reverse polarity to an electrical charge polarity of the toner may be preferably applied as a transfer bias. Subsequently, an intermediate transfer belt 5 is separated from photoreceptor 1, and a transferred image is obtained. The superimposed image on the intermediate transfer belt 5 is transferred at once onto a recording medium such as a sheet, etc., fed from the sheet feeding unit 200 by the secondary transfer roller 53.

The recording medium fed from the sheet cassette chosen from the sheet feeding unit 200 once stops at a pair of registration rollers to correct its skew (i.e., inclined deviation of a sheet), and is subsequently conveyed at a predetermined time toward the secondary transfer roller 53 provided in the secondary transfer section. The recording medium with the superimposed image transferred thereon at once is further sent to a fixing device 7, so that the toner image can be fixed there by pressure and heat. The recording medium completing the fixing process is subsequently ejected by a pair of sheet exit rollers and is stacked on a sheet exit tray 8.

Residual toner particles remaining on the electrophotographic photoreceptor 1 after the primary transfer process is removed and collected by the cleaning unit 6. Toner particles remaining on the intermediate transfer belt 5 after the second transfer process are also removed and collected by an intermediate transfer belt cleaning unit. That is, the secondary transfer device is employed in the image forming apparatus by using the intermediate transfer belt 5 in this practical example. Alternatively, however, the multiple toner images borne on more than one photoreceptor 1 can be sequentially transferred and stacked on the same position a recording medium conveyed by a conveyor belt.

Based on the above-described configuration, image quality of a practical example is compared with that of a comparative example and a comparison result is obtained through the following various experiments as listed below.

Specifically, first to fourth Tables (Tables 1 to 4) collectively indicate the evaluation result obtained based on the below described various conditions.

TABLE 1

| | Electro-photographic photoreceptor | Electrostatic capacitance: C (pF/cm$^2$) | Surface potential on charging roller: (V) | Applied amount of electrical charge: Q (nC/cm$^2$) | Electrical charge potential on photoreceptor: V (V) |
|---|---|---|---|---|---|
| First practical example | First electrophotographic photoreceptor | 118 | −400 | 47 | −300 |
| Second practical example | Second electrophotographic photoreceptor | 102 | −500 | 50.9 | −400 |
| Third practical example | Third electrophotographic photoreceptor | 132 | −250 | 33 | −200 |
| Fourth practical example | Fourth electrophotographic photoreceptor | 90 | −500 | 50.9 | −450 |
| Fifth practical example | Fifth electrophotographic photoreceptor | 144 | −250 | 33 | −180 |
| Sixth practical example | First electrophotographic photoreceptor | 118 | −450 | 52.9 | −300 |
| Seventh practical example | First electrophotographic photoreceptor | 118 | −310 | 36.4 | −300 |
| Eighth practical example | First electrophotographic photoreceptor | 118 | −400 | 47 | −300 |
| First comparative example | First electrophotographic photoreceptor | 118 | −500 | 58.8 | −300 |
| Second comparative example | First electrophotographic photoreceptor | 118 | −200 | 23.5 | −200 |
| Third comparative example | First electrophotographic photoreceptor | 118 | −400 | 47 | −300 |

TABLE 2

| | Post exposure potential VL (V) | C × \|v\| (nC/cm$^2$) | 1.5 × C × \|v\| (nC/cm$^2$) |
|---|---|---|---|
| First practical example | −30 | 35.3 | 52.9 |
| Second practical example | −35 | 40.7 | 61.1 |
| Third practical example | −25 | 26.4 | 39.6 |
| Fourth practical example | −50 | 40.5 | 60.8 |
| Fifth practical example | −25 | 25.9 | 38.9 |
| Sixth practical example | −30 | 35.3 | 52.9 |
| Seventh practical example | −30 | 35.3 | 52.9 |
| Eighth practical example | −30 | 35.3 | 52.9 |
| First comparative example | −30 | 35.3 | 52.9 |
| Second comparative example | 25 | 23.5 | 35.3 |
| Third comparative example | −30 | 35.3 | 52.9 |

TABLE 3

| | Developing unit | Initial image quality | | |
|---|---|---|---|---|
| | | Ghost | Background dirt | Other problems |
| First practical example | Non-contact and non-magnetic one component developing | OK | OK | Nothing |
| Second practical example | Non-contact and non-magnetic one component developing | OK | OK | Nothing |
| Third practical example | Non-contact and non-magnetic one component developing | OK | OK | Nothing |
| Fourth practical example | Non-contact and non-magnetic one component developing | Δ | OK | Nothing |
| Fifth practical example | Non-contact and non-magnetic one component developing | OK | OK | Nothing |
| Sixth practical example | Non-contact and non-magnetic one component developing | OK | Δ | Nothing |
| Seventh practical example | Non-contact and non-magnetic one component developing | Δ | OK | Nothing |
| Eighth practical example | Non-contact and non-magnetic one component developing | OK | OK | Slightly uneven density |
| First comparative example | Non-contact and non-magnetic one component developing | OK | NG | Scaly pattern |
| Second comparative example | Non-contact and non-magnetic one component developing | NG | OK | Nothing |
| Third comparative example | Two component developing | OK | OK | Nothing |

TABLE 4

| | Developing unit | Image quality after printing 200-numbers of sheets | | |
|---|---|---|---|---|
| | | Ghost | Background dirt | Other problems |
| First practical example | Non-contact and non-magnetic one component developing | OK | OK | Nothing |
| Second practical example | Non-contact and non-magnetic one component developing | OK | OK | Nothing |

TABLE 4-continued

| | Developing unit | Image quality after printing 200-numbers of sheets | | |
|---|---|---|---|---|
| | | Ghost | Background dirt | Other problems |
| Third practical example | Non-contact and non-magnetic one component developing | OK | OK | Nothing |
| Fourth practical example | Non-contact and non-magnetic one component developing | Δ | OK | Nothing |
| Fifth practical example | Non-contact and non-magnetic one component developing | OK | Δ | Nothing |
| Sixth practical example | Non-contact and non-magnetic one component developing | OK | Δ | Nothing |
| Seventh practical example | Non-contact and non-magnetic one component developing | Δ | OK | Nothing |
| Eighth practical example | Non-contact and non-magnetic one component developing | OK | Δ | Nothing |
| First comparative example | Non-contact and non-magnetic one component developing | OK | NG | Scaly pattern |
| Second comparative example | Non-contact and non-magnetic one component developing | NG | OK | Nothing |
| Third comparative example | Two component developing | OK | OK | Nothing |

The electrical charge potential listed in the table 1 indicates a surface potential of the electrophotographic photoreceptor generated when an electrostatic charging unit disposed in the image forming apparatus contacts and charges the electrophotographic photoreceptor with electricity while receiving a DC (Direct Current) voltage when applied thereto. The post exposure potential listed in the table 1 indicates a surface potential of the electrophotographic photoreceptor generated when the electrophotographic photoreceptor electrically charged by the electrostatic charging unit is exposed by the exposing unit provided in the image forming apparatus. The surface potential is measured using a surface potential electrometer (e.g., MODEL 344 manufactured by Trek corporation). The applied amount of electrical charge is calculated by measuring and dividing an amount of current sent between the electrophotographic photoreceptor and a grounding point by a passage area calculated based on an electrostatic charging width and a line speed of the electrophotographic photoreceptor. The electrostatic capacitance of the photosensitive body is measured by the earlier described fourth conventional technology.

The initial image quality is a quality of the image formed on approximately from first to tenth printing sheets. The image quality after 2000 number of sheets is printed represents the quality of the image formed on the 2000th sheet. Here, to evaluate the image quality, the below described image pattern is used. That is, the image pattern is composed of a belt-shaped image portion having a width, in which pixel densities of 100% and 0% repeating in the widthwise direction at every about 20 mm, and a length of about 150 mm in a sheet conveyance direction. The image pattern also includes a portion of an all page tone image of 2×2 (i.e., every dots are developed) having pixel density of 25% immediately after the belt-shaped image. With this, the presence or absence of a ghost image in the overall tone section, the presence or absence of dirt in the non-image portion, and the presence or absence of a defect in the belt-shaped image are examined and visually evaluated. Also, the image quality obtained after 2000 number of sheets have been formed is a quality of the image examined and evaluated again to confirm stability thereof based on reproduction of the belt-shaped chart having portions of pixel densities 100% and 0%, which repeat at every about 20 mm in the widthwise direction, obtained thereafter.

The reference abbreviations and a symbol OK, NG, and Δ listed in the tables 3 and 4 are given below described definitions, respectively.

In a column of the ghost image, the reference abbreviation OK indicates a relatively good level such that no ghost image is detected over the entire page. The symbol Δ here indicates a practically available level such that the ghost image is slightly perceived when viewed together with the OK level side by side. The reference abbreviation NG here indicates not available level such that the ghost image is obviously detected when viewed alone. In a column of the background dirt, the reference abbreviation OK indicates a relatively good level such that concentration fluctuations are not detected over the whole page of the belt-shaped image. The symbol Δ here indicates a practically available level such that the concentration fluctuations are slightly perceived in the belt-shaped image when viewed together with the OK level side by side. The reference abbreviation NG here indicates a not available level such that the concentration fluctuations are obviously detected in the belt-shaped image when viewed alone. In a column of the uneven concentration of belt-shaped image, the reference abbreviation OK indicates a relatively good level such that background dirt is be detected over the whole page. The symbol Δ here indicates a practically available level such that the background dirt is slightly perceived when viewed together with the OK level side by side. The reference abbreviation NG here indicates a not available level such that the background dirt is obviously detected when viewed alone.

Now, various preconditions of the first to eighth practical examples and the first to third comparative examples are described herein below in detail.

Initially, the preconditions of the first practical example are described. The electrophotographic photoreceptor 1 is prepared as described below. As a conductive cylindrical substrate, an aluminum cylinder having an outside diameter of about 40 mm with a wall thickness of about 0.8 mm is used. Onto the aluminum cylinder, undercoat layer use coating liquid, electrical charge generating layer use coating liquid, and electrical charge transporting layer use coating liquid, each having the below described composition, are sequentially coated by dipping and dried repeatedly. With this, an electrophotographic photoreceptor 1 is obtained with an undercoat layer having a thickness of about 15 μm, an electrical charge generating layer having a thickness of about 0.2 μm, and an electrical charge-transporting layer having a thickness of about 30 μm.

Coating liquid of undercoat layer use is used to prepare the undercoat layer. Specifically, the coating liquid for undercoat layer use with below described composition is coated onto the above-described aluminum cylinder (i.e., the substrate) in a dipping process, and is heated and dried at 120 degrees centigrade for 25 minutes, so that the undercoat layer having a thickness of about 15 μm is formed.

The coating liquid of the undercoat layer use is composed of: alkyd resin (e.g., Beckosol 1307-60-EL manufactured by DIC Corporation); 6 parts, melamine resin (e.g., Super beckamine G-821-60 manufactured by DIC Corporation); 4 parts, N-type semiconductor-aluminum doped zinc oxide (e.g., Pazet CK manufactured by HakusuiTech Co., Ltd.); 25 parts, electrical charge receiving material of 1, 2-dihydroxy-9,10-anthraquinone; 0.6 parts, titanium oxide (CR-EL manufactured by Ishihara Sangyo Kaisha Ltd.); 15 parts, and methyl ethyl ketone; 200 parts.

Figure 5A:
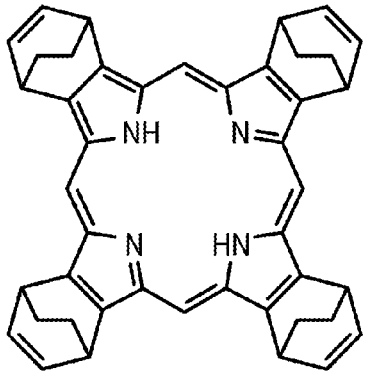
FIGS. 5A to 5C are diagrams illustrating first to third chemical formulas of coating liquid for electrical charge generating layer use, coating liquid of electrical charge transporting layer use, and fullerene derivative according to one embodiment of the present invention.

Some coating liquid for electrical charge generating layer use is used to prepare the electrical charge generating layer. Specifically, the electrical charge generating layer use coating liquid with composition represented by a first chemical formula illustrated in FIG. 5A is coated onto the undercoat layer in a dipping process. The electrical charge generating layer use coating liquid is subsequently heated and dried at about 120 degrees centigrade for about 20 minutes and is heated thereafter up to about 180 degrees centigrade with a heating rate of about 5 degrees centigrade per minute. By maintaining the above-described condition for about 15 minutes and thereby converting a precursor of tetrabenzoporphyrin into tetrabenzoporphyrin by heat, so that the electrical charge generating layer having a thickness of about 0.2 μm is formed.

The electrical charge generating layer use coating liquid is composed of: precursor of tetrabenzoporphyrin represented by the first chemical formula as illustrated in FIG. 5A; 2 parts, polyvinyl butyral (e.g., S-LEC BM-S manufactured by Sekisui Chemical Co., Ltd); 0.1 parts, and tetrahydrofuran; 50 parts.

That is, the first chemical formula is illustrated in FIG. 5A.

Some coating liquid of electrical charge transporting layer use is used to form the electrical charge transporting layer. Specifically, the electrical charge transporting layer use coating liquid with the below described composition is coated onto the above-described electrical charge generating layer by dipping thereof, and is heated and dried at 135 degrees centigrade for 20 minutes, so that an electrophotographic photoreceptor 1 with the electrical charge transporting layer having a thickness of about 30 μm is obtained.

Figure 5B:
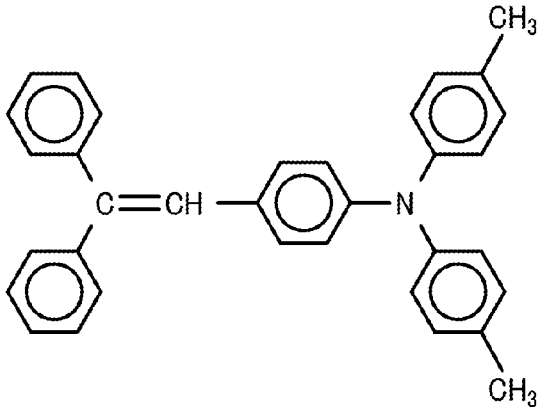
Figure 5C:
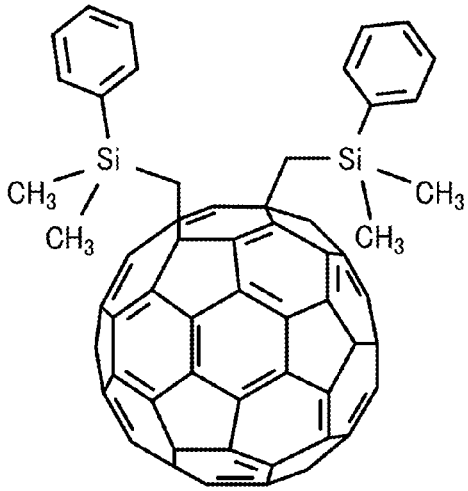

The coating liquid of electrical charge transporting layer use includes: electrical charge transporting material (D-1) with a structure formula indicated by the second chemical formula as illustrated in FIG. 5B; 9 parts, fullerene derivative represented by a third chemical formula as illustrated in FIG. 5C; 0.5 parts, bisphenol-Z polycarbonate (e.g., Panlite TS-2050 manufactured by Teijin Limited.); 9 parts, silicone oil (e.g., KF-50 manufactured by Shin-ETSU chemical Co., Ltd.); 0.002 parts, and tetrahydrofuran; 100 parts.

That is, the second chemical formula illustrated in FIG. 5B, and the third chemical formula illustrated in FIG. 5C.

An average thickness of the coating layer of the electrophotographic photoreceptor 1 thus obtained with the above-described coating liquid is about 45.2 μm. An electrostatic capacitance of the electrophotographic photoreceptor 1 measured by a conventional system is about 118 pF/cm$^2$.

Here, a pair of flanges is attached to both ends of the electrophotographic photoreceptor 1, respectively.

Now, preparation of first toner is herein below described in more detail. A parent body of the first toner is composed of:

partially cross-linked polyester resin (e.g., condensed copolymer of ethylene oxide added alcohol of bisphenol A, propylene oxide added alcohol of bisphenol A, terephthalic acid, and trimellitic acid (Mw=15000 and glass transition point=61 degrees centigrade)); 79.5 parts, carbon black; 15 parts, zirconium salt of di-tert-butylsalicyl acid; 0.6 parts, and carnauba wax (e.g., carnauba wax manufactured by Noda wax Co., Ltd.); 5 parts. The toner parent body is obtained by kneading a mixture of the above-described composition in a two-roll kneading machine for 30 minutes, and adjusting a condition of crushing and classification thereof with mechanical type crushing and air-flow type classification machines thereafter. The first toner is subsequently obtained by adding fine hydrophobic silica particles of 1 part and hydrophobic titanium dioxide fine particles of 1 part to the toner parent body of 100 parts, while mixing these for totally 2 minutes with a Henschel mixer. A distribution of a particle diameter of the first toner is subsequently measured using a coulter counter TA2, and it is found that a weight average particle diameter D4 is about 6.5 μm.

Now, a method of producing a process cartridge is described. An image forming unit used in Imagio MP-C4500 (manufactured by Ricoh Co., Ltd.,) is remodeled to employ a contact roller type electrostatic charging system. The photoreceptor 1 prepared as described above is subsequently incorporated in the image forming unit with the flanges. Here, a black cartridge is utilized.

Image quality is examined and confirmed (i.e., evaluated) as described below. A black cartridge installed in Imagio MP-C4500 is redisposed with the process cartridge prepared as described above, and the below described process is executed. First, by using the first toner (e.g., first one-component developer) as developer, a DC (Direct Current) voltage is adjusted so that an electrostatic charging voltage, i.e., a surface potential of the electrostatic charging roller, applied to the electrophotographic photoreceptor from the electrostatic charging unit becomes about −400 volts. Subsequently, a developing bias voltage is appropriately adjusted, and the image is evaluated following the above-described procedure. At this moment, however, a surface potential remaining on the electrophotographic photoreceptor after an image transfer process is not removed. Hence, an evaluation result is obtained as described in the above-described tables 1 to 4.

Now, a second practical example is described herein below. First, a second electrophotographic photoreceptor is prepared as described below. That is, the second electrophotographic photoreceptor is similarly produced to that in the first practical example except that the coating condition is changed to render the thickness of the undercoat layer to be about 12 μm and that of the electrical charge transporting layer to be about 40 μm.

An image is subsequently similarly formed as in the first practical example based on the second electrophotographic photoreceptor except that the electrostatic charging voltage applied to the electrophotographic photoreceptor from the electrostatic charging unit is changed to be −500 volts. The image is subsequently evaluated using the above-described procedure. An evaluation result obtained is listed in the above-described tables 1 to 4.

Now, a third practical example is described herein below. First, a third electrophotographic photoreceptor is similarly produced to the electrophotographic photoreceptor 1 of the first practical example except that the coating condition is changed here to render the thickness of the undercoat layer to be about 20 μm and that of the electrical charge transporting layer to be about 20 μm as well.

Subsequently, an image is similarly formed as in the first practical example except that the electrostatic charging voltage applied to the third electrophotographic photoreceptor from the electrostatic charging unit is change to be about −250 volts. The image is subsequently evaluated following the above-described procedure. A result of the evaluation is illustrated again in the above-described tables 1 to 4.

Now, a fourth practical example is described herein below. First, a fourth electrophotographic photoreceptor is similarly produced to the electrophotographic photoreceptor of the first practical example except that the coating condition is changed here to render the thickness of the undercoat layer to be about 8 μm and that of the electrical charge transporting layer to be about 45 μm as well.

Subsequently, an image is formed as in the first practical example except that the electrostatic charging voltage applied to the fourth electrophotographic photoreceptor from the electrostatic charging unit is change here to be about −500 volts. The image is subsequently evaluated in the above-described procedure. Again, a result of the evaluation is illustrated in the above-described tables 1 to 4.

Now, a fifth practical example is described herein below. First, a fifth electrophotographic photoreceptor is similarly produced to the electrophotographic photoreceptor 1 of the first practical example except that the coating condition is changed here to render the thickness of the undercoat layer to be about 22 μm and that of the electrical charge transporting layer to be about 15 μm as well.

Subsequently, an image is formed as in the first practical example except that the electrostatic charging voltage applied to the fifth electrophotographic photoreceptor from the electrostatic charging unit is change to be about −250 volts. The image is subsequently evaluated in the above-described procedure. Again, a result of the evaluation is illustrated in the above-described tables 1 to 4.

Now, a sixth practical example is described herein below. To learn the suitable maximum amount of electrical charge given to the electrophotographic photoreceptor 1 in relation to an electrostatic capacitance and a surface potential thereof, an image is similarly formed to that in the first practical example except that the electrostatic charging voltage applied to the electrophotographic photoreceptor 1 from the electrostatic charging unit is change here to be about −450 volts. The image is evaluated following the above-described procedure. Again, a result of the evaluation is illustrated in the above-described tables 1 to 4.

Now, several characteristics of comparative examples are described below. Initially, a first comparative example is described. To learn an impact of an electrical charge when it is excessively given to the electrophotographic photoreceptor 1 more than the suitable maximum amount in relation to an electrostatic capacitance and a surface potential of the electrophotographic photoreceptor 1, an image is similarly formed as in the first practical example except that the electrostatic charging voltage applied to the electrophotographic photoreceptor 1 from the electrostatic charging unit is change here to be about −500 volts. The image is subsequently evaluated following the above-described procedure. Again, a result of the evaluation is illustrated in the above-described tables 1 to 4.

Now, a seventh practical example is described herein below. To learn the suitable minimum amount of electrical charge given to the electrophotographic photoreceptor 1 in relation to an electrostatic capacitance and a surface potential thereof, an image is formed as in the first practical example except that the electrostatic charging voltage to be applied to the electrophotographic photoreceptor 1 from the electrostatic charging unit is change to be about −310 volts. The image is subsequently evaluated following the above-described procedure. Again, a result of the evaluation is illustrated in the above-described tables 1 to 4.

Now, a second comparative example is described herein below. To learn an impact of the electrical charge given to the electrophotographic photoreceptor 1 when it lowers the suitable minimum amount in relation to an electrostatic capacitance and a surface potential thereof, an image is formed as in the first practical example except that the electrostatic charging voltage to be applied to the electrophotographic photoreceptor 1 from the electrostatic charging unit is change here to be about −200 volts. The image is subsequently evaluated following the above-described procedure. Again, a result of the evaluation is illustrated in the above-described tables 1 to 4.

Now, an eighth practical example is described herein below. An image is formed as in the first practical example except that a process cartridge is used by adjusting a developing gap to bring a developing sleeve in contact with a photoreceptor. The image is subsequently evaluated following the above-described procedure. Again, a result of the evaluation is illustrated in the above-described tables 1 to 4.

Now, a third comparative example is described herein below. Several second toner particles are prepared as described below. A parent body of the second toner is initially prepared by including: partially cross-linked polyester resin (e.g., condensed polymer of ethylene oxide added alcohol of bisphenol A, propylene oxide added alcohol of bisphenol A, terephthalic acid, and trimellitic acid (Mw=15000 and Glass transition point=61 degrees centigrade)); 79.5, carbon black; 15 parts, zirconium salt of di-tert-butylsalicyl acid; 0.8 parts, and carnauba wax (e.g., carnauba wax manufactured by Noda wax Co. Ltd.); 5 parts. The toner parent body is obtained by kneading a mixture of the above-described composition in a two-roll type kneading machine for 30 minutes, while adjusting a condition of crushing and classification of particles using mechanical type crushing and air-flow type classification machines thereafter. Subsequently, the first toner particles are obtained by adding fine hydrophobic silica particles of 1 part and hydrophobic titanium dioxide particles of 1 part to the toner parent body of 100 parts, while mixing these for 2 minutes totally with a Henschel mixer. A distribution of a particle diameter of the second toner is measured using a coulter counter TA2, and it is found that a weight average particle diameter D4 is about 6.5 μm.

First carrier is prepared as described below. Initially, a first carrier coat is prepared by including: acrylic resin solution (e.g., solid content=50 weight %); 60 parts, guanamine solution (e.g., solid content=70 weight %); 15 parts, straight silicone resin (e.g., solid content=20%); 150 parts, dibutyltindiacetate; 1.5 parts, alumina particles (particle number average diameter=0.3 μm); 100 parts, carbon black; 4 parts, aminosilane; 2.5 parts, and toluene; 1500 parts. Subsequently, the Above-described mixture is dispersed in a homomixer for 30 minutes thereby obtaining the coat layer use coating liquid. Subsequently, the coat layer use coating liquid is coated onto a surface of manganese ferrite core material of 5000 parts having the average particle diameter of about 35 μm by using a fluid bed type spray coating unit. Subsequently, the first carrier is obtained by heating the above-described materials for one hour at 150 degrees centigrade of ambient temperature. Subsequently, distribution of a particle diameter of the first carrier is measured by using the micro trucks particle distribution measuring device (e.g., Model X-100 manufactured by Microtrac Co., Ltd), and it is found that weight average particle diameter (D4) is about 36.1 μm, and the number average diameter (D1) is about 34.7 μm.

Subsequently, the first carrier of about 920 parts and the second toner of 80 parts are mixed in a turbula (TM) mixer for 1 minute, thereby obtaining first two-component developer.

The process cartridge is prepared in the below described method. That is, an image forming unit employed in the imagio MP-C4500 manufactured by Ricoh Co., Ltd., is remodeled to have a contact roller type electrostatic charging system. The photoreceptor 1 prepared as described above is subsequently incorporated in the image forming unit with the flanges. Here, a black cartridge is employed.

Subsequently, an image is similarly formed as in the first practical example except that the process cartridge employing the two-component developer is used here. The image is then evaluated following the above-described procedure. An evaluation result obtained in this way is listed in the above-described tables 1 to 4.

Now, experimental results of the various practical examples and the comparative examples are compared with each other. First of all, the first to eighth practical examples are compared with the first to third comparative examples. Different from the first to eighth practical examples of the present invention employed in the image forming apparatus, image quality prominently deteriorates in the above-described first to third comparative examples because ghost image and background dirt or the like are generated due to the residual voltage on the electrophotographic photoreceptor. Accordingly, usefulness of image formation that gives a prescribed amount of electrical charge as specified by the various practical examples is verified.

Now, the first to third practical examples are compared with the fourth and fifth practical examples. The first to third practical examples show a more preferable range of an absolute value of the electrical charge potential on the electrophotographic photoreceptor. By contrast, in the fourth and fifth practical examples that deviates from the above-described more preferable range of an absolute value of the electrical charge potential on the electrophotographic photoreceptor, quality of an image slightly deteriorates sometimes at either an initial stage or after prescribed number of sheets have been continuously fed. Accordingly, it is verified that bounds (i.e., upper and lower limits) of the electrical charge potential as specified in the image forming apparatus of the above-described practical examples are more preferable to maintain the image quality.

Now, the first practical example is compared with the eighth practical example. Different from the first practical example using the non-contact type not to contact the electrophotographic photoreceptor, it is found that the background dirt tends to slightly appear chronologically in the eighth practical example that employs the contact type one-component developing unit. Thus, it is verified that the non-contact one-component developing unit is more advantageously for the image forming apparatus to maintain the image quality.

Based on the above-described comparison results, it is ultimately verified that the image quality is higher when the following inequality is established in the image forming apparatus and the process cartridge which employ the one-component developing unit; $C \times V < Q \leq 1.5 \times C \times V$ where C is the electrostatic capacitance of the electrophotographic photoreceptor, V is the absolute value of the surface potential of the electrophotographic photoreceptor after it is electrically charged, and Q is the absolute value of the electrical charge calculated based on an amount of electrostatic charging current.

Hence, according to one aspect of the present invention, since the surface potential of the electrophotographic photoreceptor after the electrostatically charging process is specified while using the above-described developing unit, an electrical charge removing device is not required in the image forming apparatus to eliminate the residual voltage generally remaining on the electrophotographic photoreceptor after it passes through the transfer device. Hence, factors degrading the image quality due to generation of a poor image, such as a ghost image, etc., which is generally caused due to the residual voltage on the electrophotographic photoreceptor can be eliminated without using a special electrical charge removing mechanism or the like. As a result, since an existing component can be simply utilized, degradation of the image quality can be likely reduced at low cost as well. That is, according to one aspect of the present invention, an image forming apparatus includes an electrophotographic photoreceptor that bears a latent image, an electrostatic charging unit that negatively charges the electrophotographic photoreceptor with electricity uniformly in an electrostatic charging process, and a latent image writing unit that writes a latent image on the electrophotographic photoreceptor electrically charged uniformly. A one-component developing unit is provided to render the latent image visible with one-component developer. A transfer device is provided to transfer the toner image developed from the electrophotographic photoreceptor to a transfer medium. The following inequality is satisfied when an electrostatic capacitance of the electrophotographic photoreceptor is C, an absolute value of a surface potential of the electrophotographic photoreceptor after electrically charged by the electrostatic charging unit in the electrostatic charging process is V, and an absolute value of an electrical charge calculated based on an amount of electrical current sent to the electrophotographic photoreceptor in the electrostatic charging process is Q; $C \times V < Q \leq 1.5 \times C \times V$ According to another aspect of the present invention, factors degrading the image quality due to generation of a poor image, such as a ghost image, etc., which is generally caused due to the residual voltage on the electrophotographic photoreceptor can be more effectively eliminated without using a special electrical charge removing mechanism or the like. As a result, since an existing component can be simply utilized, the degradation of the image quality can be more likely reduced at low cost. That is, according to another aspect of the present invention, the one-component developing unit is a non-contact type not to contact the electrophotographic photoreceptor.

According to yet another aspect of the present invention, factors degrading the image quality due to generation of a poor image, such as a ghost image, etc., which is generally caused due to the residual voltage on the electrophotographic photoreceptor can be further effectively eliminated without using a special electrical charge removing mechanism or the like. As a result, since an existing component can be simply utilized, degradation of the image quality can be more highly likely reduced at low cost. That is, according to yet another aspect of the present invention, the absolute value V of the electrical charge on the electrophotographic photoreceptor is from about 200 volts to about 400 volts.

According to yet another aspect of the present invention, factors degrading the image quality due to generation of a poor image, such as a ghost image, etc., which is generally caused due to the residual voltage on the electrophotographic photoreceptor can be further effectively eliminated without using a special electrical charge removing mechanism or the like. As a result, since an existing component can be simply utilized, degradation of the image quality can be more highly likely reduced at low cost. That is, according to yet another aspect of the present invention, the electrostatic charging unit includes: a roller-shaped electrostatic charging unit disposed in contact with the electrophotographic photoreceptor; and a voltage applying device to apply a DC (Direct Current) voltage to the roller-shaped electrostatic charging unit.

According to yet another aspect of the present invention, factors degrading the image quality due to generation of a poor image, such as a ghost image, etc., which is generally caused due to the residual voltage on the electrophotographic photoreceptor can be further effectively eliminated without using a special electrical charge removing mechanism or the like. As a result, since an existing component can be simply utilized, degradation of the image quality can be more highly likely reduced at low cost. That is, according to yet another aspect of the present invention, the latent image formed by the latent image writing unit on the electrophotographic photoreceptor substantially includes binary potentials in respective imaged and blank portions thereon.

According to yet another aspect of the present invention, factors degrading the image quality due to generation of a poor image, such as a ghost image, etc., which is generally caused due to the residual voltage on the electrophotographic photoreceptor can be further effectively eliminated without using a special electrical charge removing mechanism or the like. As a result, since an existing component can be simply utilized, degradation of the image quality can be more highly likely reduced at low cost. That is, according to yet another aspect of the present invention, a residual voltage remaining on the electrophotographic photoreceptor after a transfer process is not removed by an electrical charge removing device.

In other words, since a prescribed additional member or mechanism is not needed in order to make the electrical charge potential uniform, the cost does not increase. Specifically, generation of the ghost image on the electrophotographic photoreceptor can be likely suppressed while omitting the detecting and correcting devices conventionally additionally needed to detect and correct the ghost image even when it is generated. For this reason, the system of one embodiment of the present invention is advantageous in views of cost and simplification of a process of forming images at high speed.

Further, since generation of the ghost image can be suppressed while omitting the residual voltage detecting unit conventionally additionally needed as an essential component to detect a residual voltage of the image on the photoreceptor surface, the system of one embodiment of the present invention is advantageous in view of the cost again.

Further, generation of the ghost image can be likely suppressed as well while omitting the pre-electrostatic charging process biasing device conventionally additionally needed as an essential component, the system of one embodiment of the present invention is advantageous in view of the cost again.

Numerous additional modifications and variations of the present invention are possible in light of the above teachings. It is therefore to be understood that within the scope of the appended claims, the present invention may be executed otherwise than as specifically described herein. For example, the process cartridge and the image forming apparatus with the process cartridge are not limited to the above-described various embodiments and may be altered as appropriate. Similarly, the image forming method are not limited to the above-described various embodiments and may be altered as appropriate. In particular, an order of various steps of the image forming method are not limited to the above-described various embodiments and may be altered as appropriate.

What is claimed is:

1. An image forming apparatus, comprising:

an electrophotographic photoreceptor to bear a latent image;

an electrostatic charging unit to negatively charge the electrophotographic photoreceptor uniformly with electricity in an electrostatic charging process;

a latent image writing unit to write a latent image on the electrophotographic photoreceptor electrically charged uniformly;

a one-component developing unit to render the latent image visible as a toner image with one-component developer composed of toner particles; and a transfer device to transfer the toner image developed by the one-component developing unit from the electrophotographic photoreceptor to a transfer medium, wherein $C \times V < Q \leq 1.5 \times C \times V$, where C is an electrostatic capacitance of the electrophotographic photoreceptor, V is an absolute value of a surface potential of the electrophotographic photoreceptor after being electrically charged by the electrostatic charging unit in the electrostatic charging process, and Q is an absolute value of an electrical charge calculated based on an amount of electrical current sent to the electrophotographic photoreceptor in the electrostatic charging process.

2. The image forming apparatus as claimed in claim 1, wherein the one-component developing unit is configured not to contact the electrophotographic photoreceptor.

3. The image forming apparatus as claimed in claim 1, wherein the absolute value V of the surface potential of the electrophotographic photoreceptor is from about 200 volts to about 400 volts.

4. The image forming apparatus as claimed in claim 1, wherein the electrostatic charging unit includes:

an electrostatic charging roller disposed in contact with the electrophotographic photoreceptor; and a voltage applying device to apply a DC voltage to the electrostatic charging roller.

5. The image forming apparatus as claimed in claim 1, wherein the latent image formed by the latent image writing unit on the electrophotographic photoreceptor includes binary potentials in respective imaged and blank portions thereon.

6. The image forming apparatus as claimed in claim 1, wherein a residual voltage remaining on the electrophotographic photoreceptor after transfer is not removed by an electrical charge removing device.

7. A process cartridge, disposed in each of multiple color image forming stations provided in the image forming apparatus as claimed in claim 1, the process cartridge comprising:

the electrophotographic photoreceptor: and the electrostatic charging unit to uniformly charge the electrophotographic photoreceptor with electricity, the electrostatic charging unit including an electrostatic charging roller disposed in contact with the electrophotographic photoreceptor.

8. The process cartridge as claimed in claim 7, further comprising the one-component developing unit to render the latent image visible as a toner image with one-component developer composed of toner particles, wherein the one-component developing unit is configured not to contact the electrophotographic photoreceptor.

9. The process cartridge as claimed in claim 7, wherein the absolute value V of the surface potential of the electrophotographic photoreceptor is from about 200 volts to about 400 volts.

10. The process cartridge as claimed in claim 7, further comprising a voltage applying device to apply a DC voltage to the electrostatic charging roller disposed in contact with the electrophotographic photoreceptor.

11. The process cartridge as claimed in claim 7, wherein the latent image formed by the latent image writing unit on the electrophotographic photoreceptor includes binary potentials in respective imaged and blank portions thereon.

12. The process cartridge as claimed in claim 7, wherein a residual voltage remaining on the electrophotographic photoreceptor after transfer is not removed by an electrical charge removing device.

13. A method of forming an image, the method comprising the steps of:

negatively charging an electrophotographic photoreceptor uniformly with electricity using an electrostatic charging unit in an electrostatic charging process;

writing a latent image on the electrophotographic photoreceptor electrically charged uniformly with the latent image writing unit in the electrostatic charging process;

bearing the latent image on the electrophotographic photoreceptor;

satisfying an inequality of $C \times V < Q \leq 1.5 \times C \times V$ where C is an electrostatic capacitance of the electrophotographic photoreceptor, V is an absolute value of a surface potential of the electrophotographic photoreceptor after being electrically charged by the electrostatic charging unit in an electrostatic charging process, and Q is an absolute value of an electrical charge calculated based on an amount of electrical current sent to the electrophotographic photoreceptor in an electrostatic charging process;

rendering the latent image visible as a toner image with one-component developer composed of toner particles with a one-component developing unit; and transferring the toner image developed by the one-component developing unit from the electrophotographic photoreceptor onto a transfer medium.

14. The method as claimed in claim 13, wherein the step of rendering the latent image visible as a toner image with one-component developer composed of toner particles is performed while separating the one-component developing unit from the electrophotographic photoreceptor.

15. The method as claimed in claim 13, further comprising a sub-step of choosing the absolute value V of the electrical charge on the electrophotographic photoreceptor from a range of from about 200 volts to about 400 volts in the step of satisfying an inequality of $C \times V < Q \leq 1.5 \times C \times V$.

16. The method as claimed in claim 13, wherein the step of negatively charging an electrophotographic photoreceptor uniformly with electricity using an electrostatic charging unit is performed in the electrostatic charging process while bringing the electrostatic charging unit in contact with the electrophotographic photoreceptor, wherein the step of negatively charging an electrophotographic photoreceptor uniformly with electricity using an electrostatic charging unit further including a sub-step of applying a DC voltage to the electrostatic charging unit.

17. The method as claimed in claim 13, wherein the step of writing a latent image on the electrophotographic photoreceptor electrically charged uniformly with the latent image writing unit in the electrostatic charging process includes a sub-step of generating binary potentials in respective imaged and blank portions of the latent image formed by the latent image writing unit on the electrophotographic photoreceptor.

18. The method as claimed in claim 13, further comprising a step of leaving a residual voltage remaining on the electrophotographic photoreceptor after transfer of the toner image developed by the one-component developing unit from the electrophotographic photoreceptor onto a transfer medium unremoved therefrom until a step of negatively charging the electrophotographic photoreceptor uniformly with electricity using the electrostatic charging unit is performed in the next electrostatic charging process.

* * * * *